United States Patent [19]

Kriechbaum et al.

[11] 4,133,079

[45] Jan. 9, 1979

[54] CANISTER ROTATION MECHANISM

[75] Inventors: Kurt Kriechbaum; Herbert Walter, both of Ebersbach; Herbert König, Ebersbach-Sulpach; Max Hartmannsgruber, Kirchheim, all of Germany

[73] Assignee: Zinser Textilmaschinen G.m.b.H., Ebersbach, Germany

[21] Appl. No.: 805,214

[22] Filed: Jun. 9, 1977

[30] Foreign Application Priority Data

Jun. 10, 1976 [DE] Fed. Rep. of Germany ..... 2626011

[51] Int. Cl.[2] ..... B65H 54/80

[52] U.S. Cl. ..... 19/159 R

[58] Field of Search ..... 19/159 R, 159 A; 242/83, 47.01

[56] References Cited

U.S. PATENT DOCUMENTS

| | | | |
|---|---|---|---|
| 1,312,953 | 8/1919 | Cook | 19/159 R |
| 3,233,290 | 2/1966 | Defore | 19/159 R |
| 3,971,521 | 7/1976 | Crotti | 19/159 R X |

*Primary Examiner*—Dorsey Newton

*Attorney, Agent, or Firm*—Edwin E. Greigg

[57] ABSTRACT

Disclosed is a cannister rotation mechanism for use in combination with a fiber carding or drawing frame having a turntable arranged to deliver fiber into the cannister. Reciprocable means are shown for raising and lowering the movable cannister bottom into position to receive the fiber and later to remove the filled cannister and insert a new cannister for filling. Several embodiments of the reciprocable means are shown and described.

6 Claims, 9 Drawing Figures

FIG.7
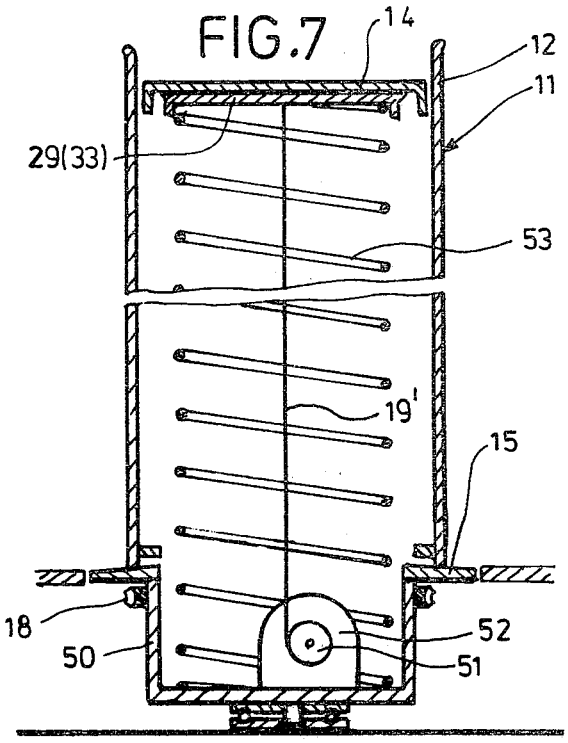
FIG.8
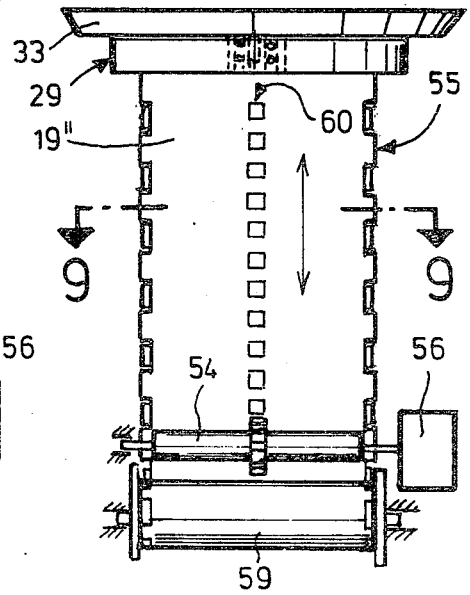
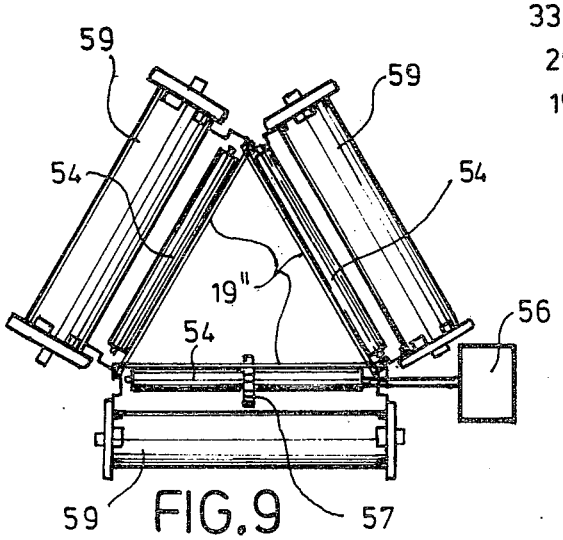
FIG.9

CANISTER ROTATION MECHANISM

BACKGROUND OF THE INVENTION

The invention relates preferably, but not exclusively to cannister rotation mechanisms for a cannister into which a fiber ribbon is fed, which after being completely filled is then transported to an open-ended spinning machine, where the fiber ribbon is drawn out of the cannister and spun into a thread. The cannisters are normally placed under the spinning mechanism of the open-ended spinning machine and cannot, therefore, have a very great height. In order, therefore, to increase the full-weight of fiber ribbon in such a cannister, so that cannister replacement is not necessary as often, it is known to maintain the fiber ribbon roll, which is formed between the turntable and the movable cannister bottom during feed-in, under pressure by a controlled, slow, downward movement of the cannister bottom, so that fiber in the cannister is compressed and a correspondingly greater fiber ribbon weight can be fed into the cannister.

A known cannister rotation mechanism (DT-OS 1 953 988) demonstrates a stroke device for the controlled lowering of the movable cannister bottom. This device contains a Nurnberger shear, also known as a pantograph, which rotates synchronously with the cannister. The necessary drive of the pantograph, however, is extraordinarily complicated and expensive and its stroke speed can only be adjusted with difficulty. This cannister rotation mechanism requires, in addition, a substantial vertical height, so that it is not possible, at least under normal conditions, to place it up on the floor of the machinery room beneath the turntable, but it must instead be partially sunk into the floor, which has tremendous disadvantages. In order to build the stroke device structurally simpler, it is known to make it in the form of a stroke-cylinder unit, which is arranged vertically and whose stroke rod raises and lowers the movable cannister bottom. This necessitates, however, a long vertical cylinder, which has such great structural height that the cylinder also must be installed below the floor of the machinery room which again is extremely undesirable.

OBJECTS, SUMMARY AND ADVANTAGES OF THE INVENTION

It is therefore the purpose of this invention to create a cannister rotation mechanism of the type mentioned in the introduction, which can be operated without difficulty, with such a low structural height that the entire device can be placed on the floor of the machinery room and yet make possible a simple embodiment of the plunger device, including its drive.

This type of cannister rotating mechanism needs only a limited structural height, because the drawing means which comprises interconnected lockable links is flexible and can therefore be diverted from its vertical direction to a preferably horizontal direction, and can be wound onto a roll or the like. Because the traveling speed of the drawing means is exactly the same as that of the cannister bottom to be moved by it, an extremely simple method of movement control is possible with a structurally simple drive. It is also possible in a very simple manner to position the speed of the drawing means at various levels so that at any time the downward speed of the drawing means can be quickly and easily changed to adjust to fiber ribbons of differing strengths and/or to adjust the compression of the fiber ribbon roll located between the cannister bottom and the turntable.

In order to raise the movable cannister bottom of an empty cannister as quickly as possible after a cannister change to get it into position to start receiving fiber ribbon, the drive of the drawing means is best switched to high speed in the vertically upward direction. This can be achieved quite simply, for example, by having the drive motor automatically activate the high speed during operational running, or this can be accomplished by means of a suitable transmission which is variable in its transmission ratios or in any other desired manner. The change in drive direction necessary for the directional diversion of the drawing means can be accomplished, for example, by means of a reversing gear, by forming the drive motor as a rotation-direction reversible electric motor for example. The downward movement of the movable cannister bottom can be carried out at a constant uniform speed, or at a programmed variable uniform speed, or especially advantageously at a step-wise downward movement with a constant time between steps or programmed, variable time steps.

In many cases it is especially advantageous, when the drive motor drives the drawing means through a stepless adjustable transmission or through a gear-shift or through a transmission with easily interchangeable tooth gears to change the multiplication. In another preferable embodiment, the drive motor is turned on and off for the downward movement in a specified cycle. The cycles are easily produced and programmed.

In one preferred embodiment it is provided for, that the cannister support table is freely rotatable about its longitudinal central axis. Then no device is required in order to rotate the drawing means around an axis of rotation, coaxial to the longitudinal axis of the cannister casing, synchronously with the cannister plate, since the freely rotatable cannister support plate rotates synchronously with the cannister casing by means of the fiber ribbon roll, which presses down on it and rotates with the cannister casing. The invention makes it possible, however, also in a simple manner, to allow the entire plunger device, including the drive motor, to rotate with the cannister plate, in that they are, for example, in a jar housing fastened to the cannister plate.

An especially simple embodiment and space-saving placement of the drawing means is achieved when the cannister-bottom bearing is continuously loaded by a pressure spring located on the bottom side. Thus, the vertical part of this drawing means is held rigid by this spring. The drawing means could comprise either a cable or a chain or the like, which, for example, can be wound around a roll, from which it can then be unwound to move the cannister bottom upwards, and then rewound onto the roll to move the cannister bottom downward.

In another equally effective embodiment, it is provided for that the cannister bottom bearing is not continuously loaded by a pressure spring on the bottom side, but rather that the drawing means (one or more) serves alone to support the cannister bottom bearing. When, in this situation, a single drawing means is provided for, an especially effective measure is to form it so that it is automatically stiffened in its vertical phase to prevent bending. The required stiffening can be undertaken in different ways. It is especially effective to form the drawing means as a flat-link articulated chain, which is stiffened or stiffenable by means located on the chain itself.

In one preferred embodiment, the articulated chain contains stops on the links themselves, which prevent adjacent links from kinking or coming out of alignment with an adjacent link, i.e. to prevent a bending of the drawing means. This type of articulated chain can then only be bent in the other direction.

In another preferred embodiment it is provided that the bending in this other direction during the vertical phase of operation is prevented by stops that can be engaged and disengaged. In this embodiment the stops are arranged so as to be disengaged during the wind up on the roll or rolls, so that the chain can be bent around the roll. Each stop can be held in its engaged position by individual springs, one for each link, or by two adjacent links which may be held by a common spring. Or, as a substitute for springs, other means could be provided, for example, permanent magnets, loading weights which could keep the stops in an engaged position.

In the case where it is desirable that the chain should be flexible in either direction, yet be stopped against bending either way during its travel in a vertical plane, the number of stops can be doubled, so that the one group of stops prevents bending in one direction, and the other group of stops prevents bending in the other direction, or one stop could be made to prevent bending in either direction.

Instead of such stops, it could be effective in many cases to equip the chain links with resetting devices, which hold them in alignment, be it by spring loading the chain links in such a way that they are pressed into alignment against stops on the adjacent link, or by arranging the spring devices so that they make possible a bending of the chain in both directions, but where the stable position caused by them is straight. The latter can be advantageously attained by making the spring device as snap springs, preferrably straight bendable springs, slightly curved in cross-section.

In another embodiment it is provided that at least three flexible metal bands, toothed along their long edges, and suitably elastic, form the drawing means. These metal bands, in the vertical phase, form a hollow pillar with the sides locked together by the teeth. The pillar has at least three corners and is thereby stiffened against bending.

The invention will be better understood as well as further objects and advantages thereof become more apparent from the ensuing detailed description of a preferred embodiment taken in conjunction with the drawing.

BRIEF DESCRIPTION OF THE DRAWING

FIG. 7 is another embodiment of a cannister rotation mechanism in a schematic cross-sectional view.

FIG. 8 is still another embodiment of a cannister rotation mechanism in side elevation.

FIG. 9 is a plan view of the plunger device in FIG. 9 along line 9—9 in FIG. 8.

DESCRIPTION OF THE PREFERRED EMBODIMENTS

Figures 1, 5, 6:
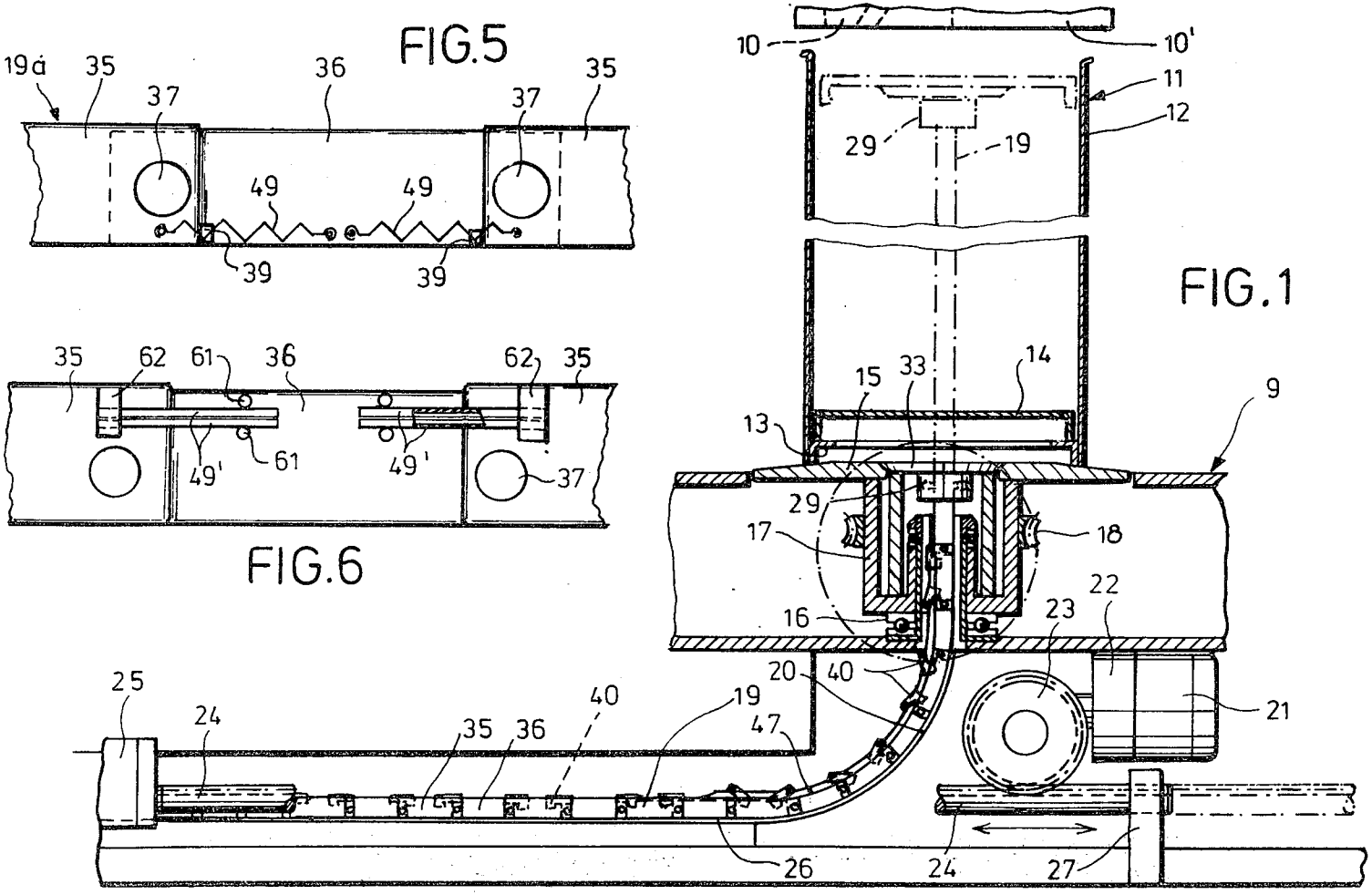
FIG. 1 is generally a cross-section side view of a first exemplary embodiment of cannister rotation mechanism described herein.
FIG. 5 is another embodiment showing a portion of the articulated chain according to FIG. 4.
FIG. 6 is another embodiment showing a portion of the articulated chain according to FIG. 4.
Figure 2:
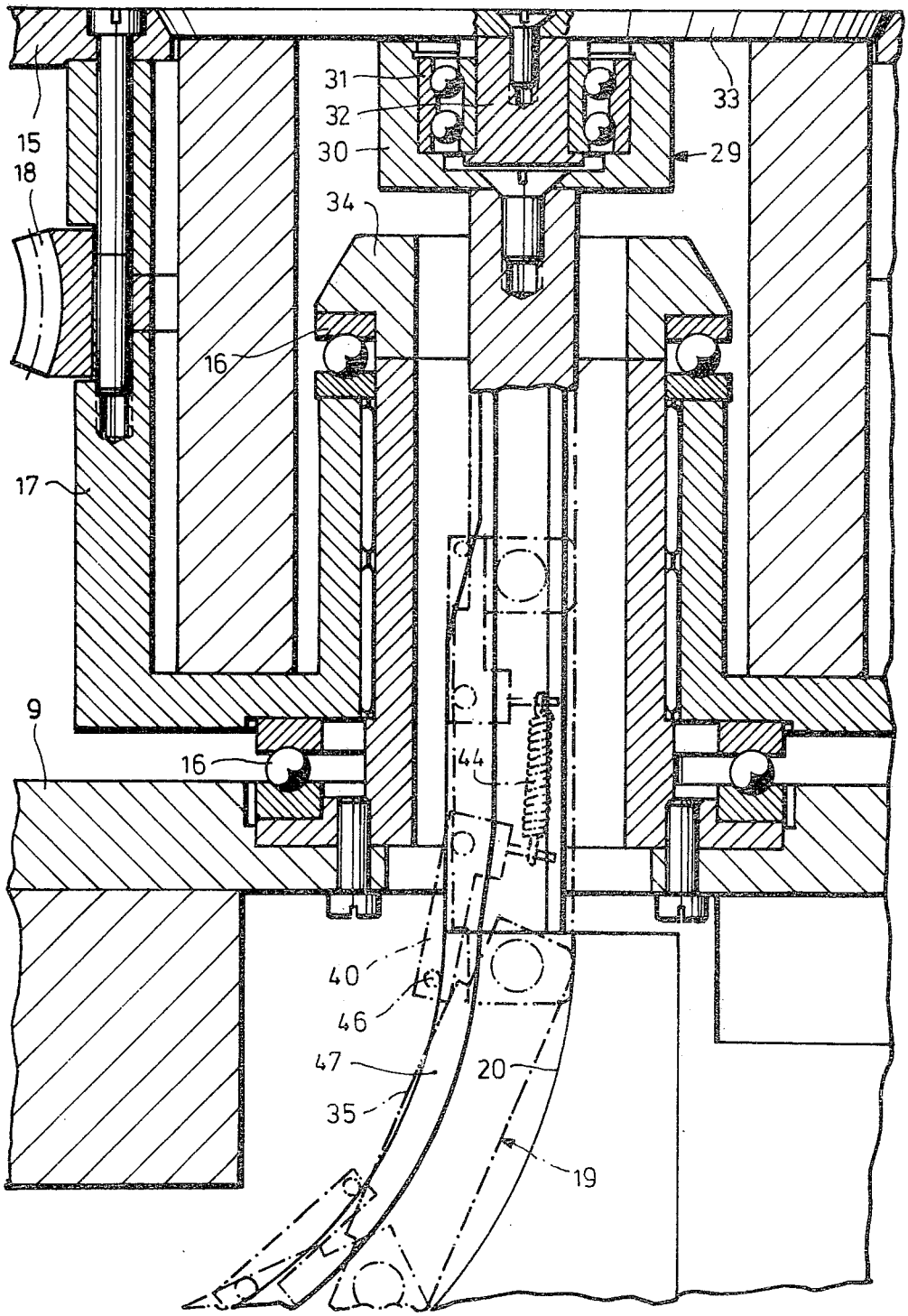
FIG. 2 is an enlarged detailed view of approximately the portion of FIG. 1 shown in a circle.

Turning now to the drawings the cannister rotation mechanism according to FIGS. 1 and 2 has a support frame 9 set up on the floor of the chamber or room housing the machinery, and is positioned beneath a coiler 10 that is set in a plate 10′ of a drawing frame or the like not shown which, by means of the turntable 10 can feed a fiber ribbon into the cannister 11. The fiber ribbon is laid into the cannister in the usual manner in cycloidal winds as a roll. The cannister 11 comprises a cannister casing 12, which is provided on the inside near the bottom with an inner-flange 13, upon which rests a loose cannister bottom 14, which forms a special part of the cannister 11. The cannister bottom 14 can be moved from the position shown in the drawing rapidly upwardly by means of a plunger mechanism to the highest dotted line position near the upper opening of the cannister casing. The cannister casing 12 is set loosely on a rotatable driven cannister turntable 15, whose rotation bearings 16 support a cup-shaped unit 17, which is firmly connected to the cannister turntable 15, and arranged for rotation about a vertical axis. This cup-shaped unit 17 is surrounded by a gear 18, which is firmly connected to it. This gear 18 meshes with a worm gear, (not shown) which in turn is driven by a motor, also not shown, for driving the cannister turntable 15. When the cannister 11 is filled with fiber ribbon, it is removed and a new empty cannister is substituted therefor.

The stationary plunger device which serves for reciprocation of the cannister bottom 14 shows means in the form of an articulated chain 19 that is supported on a trackway which includes a curved portion 20 thus providing for both horizontal and vertical movement of the chain. This articulated chain 19 is driven by an electric motor and arranged to drive the chain in the direction desired. The motor 21 drives a gear 23 through an adjustable transmission 22. The gear 23 meshes with a toothed rod 24 supported by bearings 27 (one shown). The rod 24 is adapted to reciprocate a slidable carriage 25 to which it is attached along a horizontal stationary guide track 26 with the trailing end of the articulated chain 19 being attached to the carriage 25. The leading end of the chain 19 extends beyond the end of the track and is rigidly attached to a housing 30 (FIG. 2) of a cannister bottom bearing support 29 by a screw. A ball-bearing 31 is disposed and supports a central plug 32 of a freely rotatable disk 33 the upper surface of which is flush with the turntable 15 in the lowermost position of the movable bottom actuating means.

The disk 33 is urged upwardly against the lower surface of the cannister bottom 14 by means of the articulated chain 19 and is capable of moving the cannister bottom 14 up to the upper position shown by broken line with continued upward movement of the chain 19. The upward movement always takes place at high speed with an empty cannister 11 in order that as little time as possible is lost between cannister change and the point when fibers can again be fed into the new cannister. The cannister bottom 14 and the bearing support 29 are caused to be moved downward by means of the articulated chain and its moderate speed of movement is thereby made to correspond to delivery of fiber ribbon through the turntable 10 so that a desired compression of the fiber roll lying against both the coiler 10 and the cannister bottom 14 is achieved and no further compression means are necessary. By reason of this construction the full weight of the cannister 11 can be approximately doubled.

The disk 33, shown in FIGS. 1 and 2 in its rest position, is held freely rotatable and is driven synchronously with the cannister casing 12 by means of the fiber ribbon roll which rotates with the cannister casing 12.

The horizontal extent of the articulated chain 19 glides along the track 26 with the carriage 25. The curved track portion 20 for the articulated chain 19 joins the horizontal guide track 26 on one end, and terminates at the beginning of the vertical extent of the chain 19. This vertical extent of the articulated chain 19 penetrates a stationary casing 34 which is disposed on the support frame 9. Because no guides are provided on the vertical extent of the articulated chain 19 to prevent a sideways bending thereof, the chain 19 is so formed that during its periodic vertical excursions it possesses sufficient internal stiffness to carry the weight loaded on it without bending. It is sufficient in this regard if the links in the vertical extent of the chain cannot deviate from each other, even if that portion of the chain 19 is not absolutely rigid in itself, but can bend a bit to the right or left, because the cannister casing sides serve as sideways guides for the cannister bottom 14.

Figure 4:
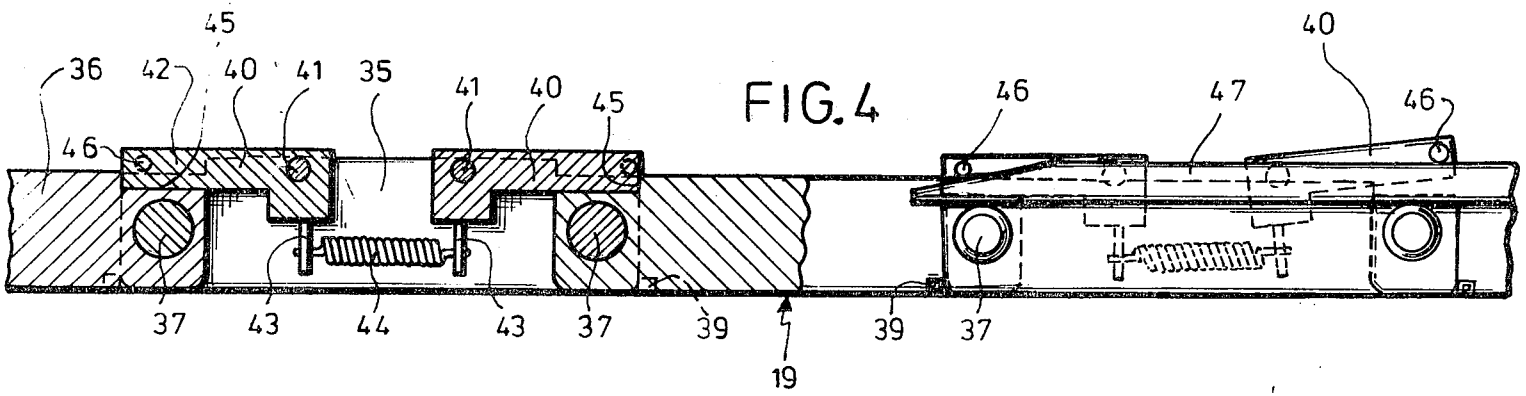
FIG. 4 is a side view of the articulated chain according to FIG. 3, which is partially cut away along the line 4—4 in FIG. 3.
Figure 3:
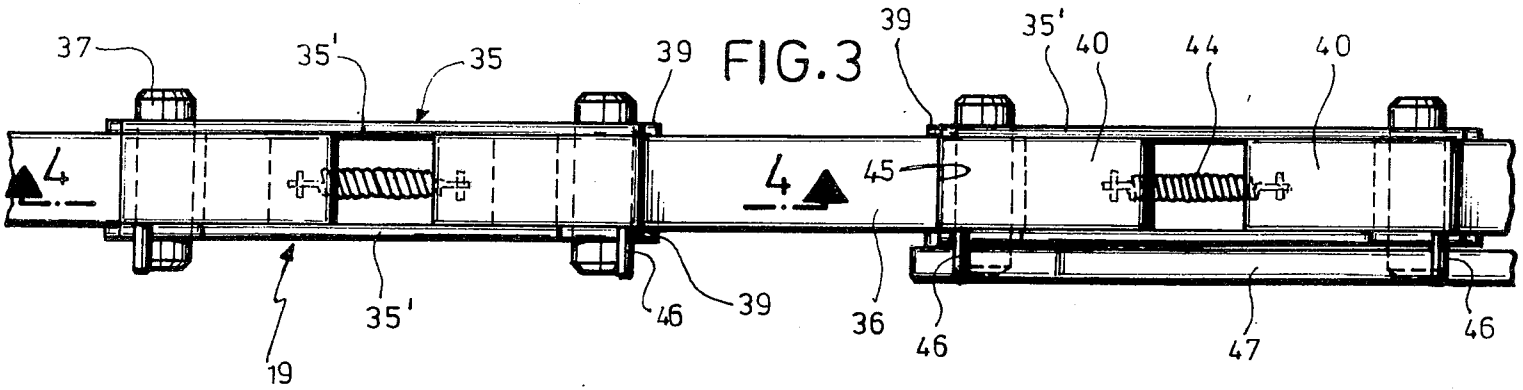
FIG. 3 is a top plan view of the articulated chain of the device in FIG. 1.

The articulated chain 19, as shown in FIGS. 3 and 4, is composed of alternating inner and outer chain links 35 and 36, which are rotatably connected by cylindrical bolts 37 in a commonly known manner. Every inner chain link 36 has a rectangular cross-section and includes at the bottom of each of its two long sides two stops 39 for the front sides of the two cover plates 35' of the juxtaposed outer chain links 35. The stops 39 prevent the articulated chain 19 from bending downwards out of the straight configuration shown in FIG. 4, so that it is only flexible in the direction necessary for it to follow the curved area 20 on the guide track. In order to keep the vertical extent of the chain 19 from bending in the direction not blocked by the stops 39, the chain 39 has swivel-mounted blocks 40, which might also be designated as cross-bars. Specifically, on the cover plates 35' of each outer chain link 35 two identical blocks 40 are carried by bolts 41 which in turn are carried by the cover plates 35' and extend in opposite directions. The blocks 40 are swivel-mounted around a rotating axis parallel to the axis of the bolt 37. Each block 40 has an L-shaped main piece 42 provided with a dependent rod 43. Suspended between the rods 43 of the two blocks 40 of each outer chain link 35 is attached a tension spring 44, which pulls the blocks 40 into the position shown in FIG. 4, in which position the length of the blocks 40 catch and form-lock in rectangular recesses 45 of the inner chain links 36, and thus impede any upward bending of the outer chain links 35. In addition, on one side of each block 40 a horizontal bar 46 is firmly attached which serves to uncouple the blocks 40 by means of an opening rail 47. This opening rail 47 has on each of its ends a canted surface for engagement with the bars 46 and extends at the side of the chain parallel to the curved area of the guide track 20 a bit over the bow 20 into the straight sections. The blocks 40 are disengaged from the recesses 45 at the curved area 20 of the chain 19 by the rail 47, so that the chain 19 can more readily follow the bend in the guide track 20. In the vertical extent of the chain 19 and also over almost the entire extent of the horizontal guide track, the blocks are engaged on the recesses 45, so that in these areas the chain links are form-locked in a straight position by the blocks 40 and the stops 39, and in this way the vertical extent of the chain 19 can carry the support bearing 29 alone without kinking. Also, this arrangement prevents the chain from lateral bending under the drive pressure on the horizontal guide track 26.

As mentioned hereinbefore, the chain 19 is reciprocated back and forth as desired by the rack and pinion 24, which is attached to the slidable carriage 25 and driven by the motor 21, whereby the upward movement of the cannister bottom 14 caused by the chain 19 proceeds at a speed and the downward movement proceeds according to the desired compression of the fiber roll at a predetermined pace. The slow downward movement can be readily accomplished by a periodic turning on and off of the motor 21, so that two different speeds for the motor are not necessary, and no change in the transmission gearing need be made.

The feed-in of the fiber ribbon into the cannister 11 can be interrupted by means of a meter counter after a certain length of ribbon has been fed thereinto, and by then simultaneously turning on the motor 21 to working speed so that the remaining downward movement of the support bearing 29 proceeds at high speed until it arrives in the position shown in FIGS. 1 and 2. In the lowermost position, the upper side of the disk 33 is flush with the upper side of the turntable 15 thus the filled cannister can be slid out without having to lift it over the turntable 15. As soon as the filled container is removed an empty cannister is pushed onto the cannister plate, and the cannister bottom 14 is then raised quickly to its upper position by the chain 19 to begin the new feed-in of fiber ribbon and slow downward movement of the cannister bottom 14 is begun by the chain 19.

As a result of the curved area of the articulated chain 19 from its vertical extent to the horizontal, a low structural height is achieved for this cannister rotation mechanism, so that it can be easily set on the floor of the machinery room along with the associated stretching frame or the like.

The articulated chain 19 is capable of numerous variations. For example, it could be effective in some cases to have the blocks prevent a bending in both directions, for example, by providing each block with a projection, which in the engaged position form-locks into a groove in the chain 19, so that the stops 39 could be left out.

With the articulated chain **19*a* shown in FIG. 5, the cannister rotation mechanism could be built as shown in FIGS. 1 and 2 with the exception that the disengaging bar 47 would not be necessary because on the chain 19*a* instead of the blocks 40, initially tensioned tension springs 49 are situated so that each tension spring 49 attached to an inner chain link 36 pulls the adjacent outer chain link 35, to which the other end of the spring in attached, against the stops 39 of the inner link. The chain 19*a* can thus be bent out in only one direction and only by a force sufficient to overcome the tension in the springs. The stops 39 are similar to the stops 39 of the chain 19 according to FIGS. 3 and 4 and have the same function. The tension springs on the other hand replace the blocks 40. During the periodic running of the chain through the curved guide track 20 (FIG. 2), the chain links 35, 36** deviate from their alignment.

Provision could also be made for having the chain in the curved area 20 led only not along the outer guide track, but also along an inner guide track, i.e. the chain could pass between two parallel guides with a small amount of play allowed for therebetween. In this manner the chain is not allowed to spring up in a straight line across the curve area 20. The tension in the springs 49 is great enough that the chain 19*a* cannot be kinked by the weight it carries and consequently is also stiff enough to securely carry alone the cannister bottom without kinking even with the increasing weight and pressure of the fiber ribbon that is fed into the cannister 11.

In a further embodiment of an articulated chain 19*b* according to FIG. 6, each outer chain link 35 is provided with two pairs of snap springs 49' which are form-locked firmly in blocks 62 and arranged to extend along the direction of the length of the chain. Each snap spring 49' in cross-section forms a slightly bowed relatively straight leaf spring and the two springs in each such pair have their concave sides turned towards each other. They are parallel and extend on their free ends between two projections 61 that are disposed on the associated inner chain link 36. Thus, the stable position of the chain 19*b* is straight, and the chain links 35, 36 can only be pulled out of this straight position toward either side under force sufficient to overcome the strength of the snap spring pair 49'. This chain 19*b*, too, has, as a result of the snap springs 49', sufficient internal stiffness to carry the cannister bottom support 29 (FIG. 1,2) alone and still be able to be bent through the guide track 20 (FIG. 1,2).

In the exemplary embodiment of a cannister rotation mechanism according to FIG. 7, on the underside of the rotatable driven turntable 15, which carries the cannister housing 12 this not being shown in any detail, a pan-shaped housing 50 is firmly disposed, in which a winch 51 with an associated motor 52 is situated, so that this winch 51 and the drive motor 52 rotate with the turntable 15. The drive motor 52 can be an electrical geared motor with a self-locking transmission, to which electricity is led by a contact ring (not shown) provided on the jar-shaped housing 50. On the winch 51, which can be a cylindrical spool, driven by the motor 52, a flexible actuator means 19' is situated, preferably in the form of a single-layer wound cable, whose other end is fastened on the cannister bottom bearing support 29, which in this embodiment forms only the disk 33. A spiral pressure spring 53 supports itself on one end on the inner floor on the jar housing 50 and on the other end on the disk 33. This pressure spring 53 is chosen so that it holds the drawing means 19' taut between the disk 33 and the winch 51, even when the cannister bottom 14 is loaded under the weight and the pressure of the maximum amount of fiber ribbon that can be fed into the cannister 11. Thus one can move the disk 33 and the cannister bottom 14 lying on it between the lowest and highest positions by means of the winch 51, whereby the drawing means 19' is held taut, so that the cannister bottom is movable in a predetermined manner at desired speeds. In this manner slow downward movement of the cannister bottom is, again, made especially effective by alternately turning the motor on and off.

This embodiment of the invention also has a low structural height for a cannister rotation mechanism, as well as a very simple construction and needs only little space even in a horizontal direction, so that it is especially space-saving.

In the embodiment of the invention which relates to a stationary elevating mechanism according to FIGS. 8 and 9, the cannister bottom bearing support 29 the disk 33 of which is swivel-mounted in a bearing of the cannister bottom bearing support 29, as in FIGS. 1, 2, is carried by a hollow, vertical pillar formed by three springy elastic metal bands 19". In this construction each single metal band 19" is led by a stationary rotatably fixed lead roller 54 to its own stationary wind up roll 59, onto which it can be wound, and off of which it can be unwound. The lead rollers 54 can be loaded with a turning moment in the wind-up direction by spiral springs. The three bands 19" which form the drawing means having upstanding portions which intersect as shown in FIG. 9 so that the resulting pillar 55 has the approximate cross-section of an equilateral triangle, which is particularly effective. In addition, in the upper end area of these bands 19", their vertical edges can be permanently joined, in order to form a short permanent pillar which joins the cannister bottom bearing support 29 on the underside. This short pillar is rigidly affixed to the cannister bottom bearing support 29. The remaining side edge portions of the bands 19" are toothed so that adjacent teeth mesh, thus the pillar 55, at any extension length, is stiff enough to carry the cannister bottom and the weight of the load upon it as well as the Pressure of the fiber ribbon fed into the cannister 11. Accordingly, no spring is required to provide for support of the cannister bottom plate.

In some instances it is sufficient for just one of these three bands 19" to be driven by a motor 56, as shown, with this motor arranged to drive the lead roller 54 and therethrough a gear 57, which is firmly fixed on the roller 54, since the two other bands 19" will be driven synchronously with the driven band 19". The gear 57 meshes with a central longitudinal perforation 60 of the concerned metal band 19", but can, if necessary, engage in teeth provided along the edge of the band 19" or there can also be two gears located on the driving lead roller, which engage in corresponding toothed areas.

On one of the metal bands 19", the toothed areas are longitudinally offset.

As mentioned earlier herein, the filled cannisters 11 serve especially as supply cannisters for open ended spinning machines, thus their height is not very great. These cannisters have, for example, 9" diameter and 36" height. With such dimensions, as a result of the compression of the fiber ribbon roll, full weights of approximately 6 kg. can be achieved.

The structural heights of the cannister rotation mechanisms according to the invention can be held very low, preferable below 30 cm. As an example, a cannister rotation mechanism built for testing purposes according to FIGS. 1 and 2 had a height of 26 cm. Since the cannister rotation mechanisms can be set up on the floor of the machinery room where the installation is made, one can simply adjust the eccentricities of the cannister plate 15 to the turntable 10 by shifting the cannister rotation mechanism.

What is claimed is:

1. For use in connection with a carding machine, drawing frame or the like, a cannister handling mechanism for sliver collection comprising:

a frame;

an annular turntable rotatably mounted on said frame for supporting a cannister having a movable bottom thereon;

means for rotating said turntable;

a trackway having a first portion extending horizontally beneath said frame and a second portion curving upwardly and terminating in a vertical portion in said frame below and concentric with said turntable;

elongate means flexible in at least one plane supported on said trackway; and horizontally reciprocable drive means connected to said flexible means at a point remote from the vertical portion of said trackway for positioning the opposite end of said flexible means in engagement with the underside of said movable cannister bottom to position said bottom at any desired height therewithin.

2. Apparatus as defined by claim 1 wherein said flexible means includes a disk freely rotatably attached to the end remote from said drive means for engaging with the movable cannister bottom.

3. Apparatus as defined by claim 1 in which said elongate flexible means comprises an articulated chain having interconnected links.

4. Apparatus as defined by claim 3 in which said links of said articulated chain include interlocking means for juxtaposed links.

5. Apparatus as defined by claim 4 including means for disengaging said interlocking means as said chain enters a vertical plane from a horizontal plane.

6. Apparatus as defined by claim 4 and including spring means biasing said interlocking means toward interlocked position.

* * * * *